United States Patent [19]

Tanabe

[11] Patent Number: 4,564,985

[45] Date of Patent: Jan. 21, 1986

[54] FELT FOR PAPER MANUFACTURE AND METHOD FOR PRODUCING THE SAME

[75] Inventor: Takeo Tanabe, Kounosu, Japan

[73] Assignee: Nippon Felt Co., Ltd., Tokyo, Japan

[21] Appl. No.: 433,419

[22] Filed: Oct. 7, 1982

[30] Foreign Application Priority Data

Oct. 8, 1981 [JP] Japan ..... 56-160765

[51] Int. Cl.[4] ..... D06C 3/00

[52] U.S. Cl. ..... 28/142; 28/110; 428/909

[58] Field of Search ..... 428/234, 286, 287, 280, 428/282, 284, 300, 110, 142, 909; 162/DIG. 1, 358; 139/383 A; 156/148; 28/107, 112

[56] References Cited

U.S. PATENT DOCUMENTS

| | | | |
|---|---|---|---|
| 3,123,892 | 3/1964 | MacMillan | 28/112 |
| 3,214,329 | 10/1965 | Wicker | 162/358 |
| 3,214,330 | 10/1965 | Wicker | 162/358 |
| 3,214,331 | 10/1965 | Wicker | 162/358 |
| 4,107,367 | 8/1978 | Fekete | 428/282 |
| 4,162,190 | 7/1979 | Ashworth | 428/280 |
| 4,187,618 | 2/1980 | Diehl | 139/383 A |
| 4,251,588 | 2/1981 | Goetemann et al. | 139/383 A |
| 4,314,589 | 2/1982 | Buchanan et al. | 162/DIG. 1 |
| 4,369,081 | 1/1983 | Curry et al. | 428/234 |
| 4,388,364 | 6/1983 | Sanders | 428/287 |
| 4,425,392 | 1/1984 | Oikawa et al. | 428/234 |

FOREIGN PATENT DOCUMENTS 1030994 5/1966 United Kingdom .

*Primary Examiner*—George F. Lesmes
*Assistant Examiner*—William M. Atkinson
*Attorney, Agent, or Firm*—Barnes, Kisselle, Raisch, Choate, Whittemore & Hulbert

[57] ABSTRACT

A felt for paper manufacture and the method for producing the felt. At least two fabrics having a single weave or double combination weave structure are piled to form a ground fabric. A lap is fed on the ground fabric and the lap and fabrics of the ground fabric are combined with each other by needling.

7 Claims, 7 Drawing Figures

FELT FOR PAPER MANUFACTURE AND METHOD FOR PRODUCING THE SAME

BACKGROUND OF THE INVENTION

The present invention relates to a felt for paper manufacture and the method for producing it.

Recently, the operating speed of paper manufacturing machines has been increased remarkably, and with this increase of the operating speed, the load imposed on press parts utilized for squeezing a wet web by press rolls has been increased. When the operation is carried out at an increased paper-producing speed, the time during which a wet web is retained in the nip portion between press rollers becomes shortened and therefore, the water discharge speed from the wet web should be increased at the pressing step.

The above-mentioned increase of the load is necessary to cope with this increase of the water discharge speed. However, if a high load is applied by the press rolls, the hydraulic pressure is increased when water is squeezed out from the wet web, and displacement of fibers in the wet web, that is, so-called paper breaking, is readily caused. Furthermore, the felt is flattened in a short time and becomes harder and the water permeability and air permeability of the felt are degraded. This phenomenon is called "sagging", and if sagging of the felt is caused, since voids, or empty spaces of the felt, for receiving water squeezed out from the wet web in the nip of the press rolls are reduced, removal of water from the wet web cannot smoothly be performed.

Recently, there has been developed an apparatus called "broad-width nip press", in which a wet web gripped between two felts is passed through one roll and a belt partially pressed to the roll and a strong pressing force is applied from the belt side to squeeze out water from the wet web. The felt of this apparatus is introduced into the nip portion while having voids sufficient to completely receive water squeezed out from the wet web, the felt receives water, and after the felt has separated from the nip portion, water is removed from the felt by suction or the like. Also in this apparatus, if sagging of the felt is caused, the capacity for receiving water becomes insufficient. Accordingly, it is important that sagging should be prevented as completely as possible.

If the felt for paper manufacture is completely non-compressible, even though the capacity of voids is sufficient, paper breaking is often caused because a high pressure is applied to the wet web at the moment when the wet web is introduced into the nip portion between rolls. Ideally, a felt for paper manufacture should have a certain compressibility providing a maximum pressure to the wet web over a period of a certain time and a certain non-compressibility necessary for retaining a sufficient capacity of voids. Of course, it is required that the recovering property after removal of the load should be high.

A so-called needle felt has been proposed as the felt for paper manufacture satisfying these requirements. This needle felt comprises a non-compressible ground fabric and a lap bonded to the ground fabric by needling, and retention of a sufficient capacity of voids is mainly attained by the ground fabric and retention of a necessary compressibility is attained by the lap. When the thickness of the ground fabric is increased so that deformation is hardly caused, voids are sufficiently retained and the ability to receive water from the wet web in the roll nip portion is increased. Accordingly, trials have been made to provide felts comprising a ground fabric having a double combination weave or a multiple combination weave such as a triple combination weave. However, a multiple weave fabric such as a triple weave fabric is practically insufficient in that formaton of a uniform texture by weaving is very difficult and since the resistance to bending is very high, handing is very difficult at the post treatment after the weaving operation or at the step of setting the felt at a paper manufacturing machine.

SUMMARY OF THE INVENTION

It is a primary object of the present invention to provide a felt in which the above-mentioned defects of conventional felts for paper manufacture are eliminated, the capacity of voids is increased and sagging is hardly caused.

The basic concept of the present invention capable of attaining the above object is that a multiple weave such as a triple weave is not adopted and at least two fabrics having a single weave or double combination weave structure, which can easily be formed by weaving, are piled to form a ground fabric.

The felt of the present invention comprising a ground fabric formed by piling a plurality of woven fabrics including at least two non-compressible fabrics is advantageous over the conventional felt comprising one multiple weave fabric as the ground fabric in that the ground fabric is soft and rich in the water-absorbing property and sagging is hardly caused even if the felt is used for the high-speed operation. Furthermore, according to the method of the present invention, a felt having uniform properties throughout the entire structure can be prepared very easily. Moreover, in the present invention, since a ground fabric comprising a plurality of fabrics is used, it is easy to produce a felt for paper manufacture having front and back fabrics having weave structures most suitable for the paper manufacturing operation. Accordingly, the present invention makes great contributions to enhancement of the quality of a paper-making felt, increase of the operation speed in a paper manufacturing machine and improvement of the quality of formed paper.

BRIEF DESCRIPTION OF THE DRAWINGS

FIG. 4-B is an enlarged view showing the portion A in FIG. 4-A.

DETAILED DESCRIPTION OF THE INVENTION

The following detailed description is of the best presently contemplated mode of carrying out the invention. This description is not to be taken in a limiting sense, it is made merely for the purpose of illustrating the general principles of the invention since the scope of the invention is best defined by the appended claims.

Figure 1:
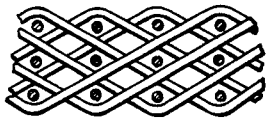
FIG. 1 PRIOR ART
FIG. 1 is a diagram illustrating a triple weave fabric.
Figure 2:
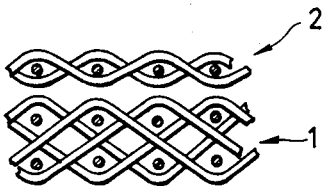
FIG. 2 is a diagram illustrating the structure of the ground fabric in the present invention.
Figure 3:
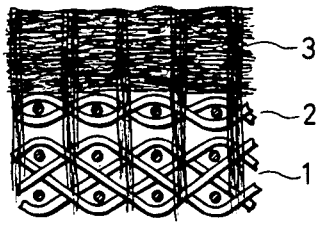
FIG. 3 is a diagram illustrating one embodiment of the felt according to the present invention.

FIG. 1 shows a triple weave fabric. In the present invention the triple or other multiple fabric is not used, but as shown in FIG. 2, a double combination weave fabric 1 and a single weave fabric 2 are piled together to form a ground fabric at the needling step (the formed felt in this embodiment is shown in FIG. 3, in which reference numeral 3 represents the lap). Furthermore, a ground fabric corresponding to a double weave fabric, which is formed by piling two single weave fabrics, and other combinations may optionally be chosen.

Various advantages can be attained by using the above-mentioned ground fabric having a plurality of layers according to the present invention. For example, a relatively thin fabric comprising a plurality of fabrics having a single weave or double weave structure, which is easily formed by weaving and is stable in quality, can be used, and as compared with a single-layer multiple-weave fabric having the same thickness, this multi-layer fabric can be handled at the needling step or the like more easily and the resulting felt is excellent in softness and the like. Furthermore, setting of the felt of the present invention at the paper manufacturing can be performed very easily. Moreover, a high bulkiness (high void ratio) can be attained very stably and sagging is hardly caused in the felt of the present invention.

The needle felt for paper manufacture of the present invention may be prepared according to the following procedures. A plurality of woven fabrics including at least two non-compressible fabrics are used as the material of the ground fabric, and they are piled together in a substantially equal length in an endless manner and set at a needle punching machine in this state. In this case, all the fabrics used may be of the same kind. However, in order to prevent formation of ground fabric mark troubles on paper through the lap layer, there may be adopted a method in which a rough and rigid non-compressible fabric having a large void capacity is arranged on the side to be located on the back face when the resulting needle felt is actually used and a non-compressible fabric having a high yarn density, which is formed by using a finer yarn than on the back side, is arranged on the side close to the lap layer surface which is to fall in contact with a wet web. Moreover, in order to enhance the effect of needle punching with the lap layer, there may be adopted a method in which a soft yarn is used as a part of yarns to be used for formation of a fabric closer to the lap layer. All of the fabrics to be used may be of a single weave structure. However, in order to obtain a desirable ground fabric comparable to a triple weave or quadruple weave ground fabric, in view of the easiness in formation of the ground fabric, it is preferred that at least one double weave fabric be included.

In the case of a single weave fabric, as the weave structure, there may be adopted weave structures customarily adopted for formation of ground fabrics of needle felts for paper manufacture, for example, plain weave, 2/2 twill weave and 3/1 twill weave structures. In the case of a double weave fabric, in view of the easiness in retention of voids and the attainment of a high tenacity, it is preferred that 3/2 twill warp backed weave, front 1/3 twill-rear plain double weave and 1/3 twill weft backed weave structures be adopted.

It is preferred that hard yarns, for example, synthetic polymer monofilament yarns, strongly twisted yarns of monofilaments and yarns having the hardness increased by a resin treatment, be used for formation of non-compressible fabrics. However, if the yarn used is hard and rigid, handling becomes difficult. In order to retain characteristics of monofilaments such as high resistance to deformation, easiness in retention of a sufficient void capacity and high resistance to sagging while maintaining certain flexibility and easiness in handling, it is preferred that a yarn formed by twisting several fine monofilaments be used. Accordingly, it is especially preferred in the present invention that monofilament yarns or yarns formed by twisting monofilaments be used and at least one of a plurality of fabrics be a fabric having a double combination weave structure.

The method for needle-punching a lap placed on at least two endless belt fabrics piled together will now be described.

Figure 4A:
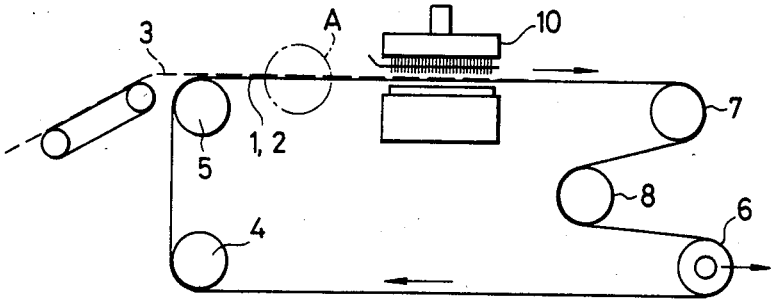
FIG. 4-A is a diagram illustrating the preparation method according to the present invention.
Figure 4B:
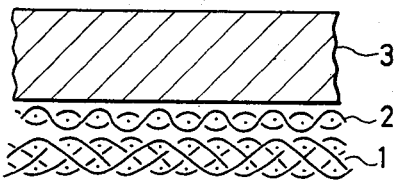

An embodiment in which two fabrics are used is described. According to the method of the present invention, as shown in FIG. 4-A (the portion A is shown in an enlarged view of FIG. 4-B), two fabrics 1 and 2 are piled in the annular form and supported by rolls 4, 5, 6 and 7. The stretch roll 6 is pulled in the direction indicated by the arrow to apply a strong tension to the fabrics 1 and 2 so that even if there is a difference of the length between the two fabrics 1 and 2, the longer fabric is not slackened. In this state, the fabrics are turned by a delivery roll 7 and a drive roll 8, and a lap 3 is supplied and the needling operation is carried out in a needling zone 10.

Figure 6:
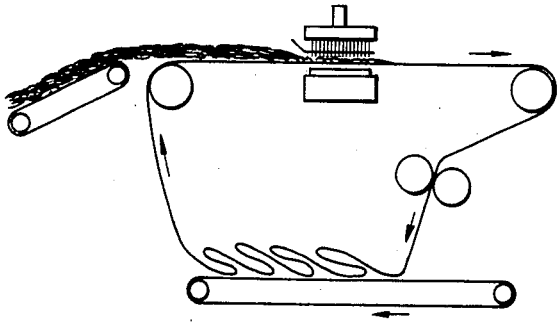
FIG. 6 PRIOR ART
FIG. 6 is a diagram illustrating the conventional apparatus.

In the conventional method using a single-layer ground fabric, as shown in FIG. 6, a ground fabric and a product semi-fabricated product outside the needling zone are placed on the conveyor in the slackened state without application of a tension. In this case, the ground fabric is considerably shrunk in either the longitudinal direction or the lateral direction according to the texture and the needling conditions. Also in the case where two fabrics are piled to form a ground fabric, if a part of the ground fabric is slackened on the needling machine or the tension is small even in the stretched state, slacking is caused in one of the fabrics according to the difference of the shrinkage factor, or there is formed a felt in which the weft density in the initially needled portion is different from the weft density in the finally needled portion. However, occurrence of this disadvantage can be avoided if a strong tension is applied to the ground fabric during the needling operation so that all the fabrics are kept strained, as pointed out hereinbefore. It is preferred that the applied tension be about 0.3 to about 5 $kg/cm^2$ per fabric on the average.

When one lap is placed on one surface of the ground fabric comprising two fabrics and the initial needling is performed, short fibers of the lap are pierced through the two fabrics on the entire surfaces thereof and the assembly is integrated. Accordingly, at the step of needling second and subsequent laps, application of a strong tension is not particulary necessary.

Figure 5:
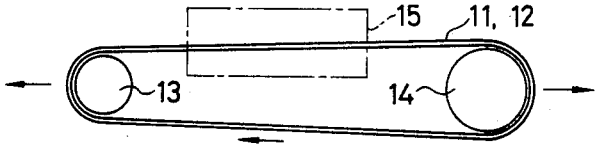
FIG. 5 is a diagram illustrating the constantlength heat setting treatment in the method of the present invention.

In the method of the present invention, in the case where the length difference in at least two endless belt-like fabrics is too large for some reason or other and the length cannot be uniformalized even if a tension is applied as pointed out hereinbefore, or in the case where it is expected that the shrinkage factors of the respective fabrics under needling will differ greatly, it is preferred that the respective fabrics (or fabrics having an extremely short length or an especially large shrinkage factor) be stretched to a certain length and thermally set. For example, as shown in FIG. 5, two fabrics 11 and 12 are piled together, elongated by stretch rolls 13 and 14 and thermally set by a hot air heater 15. Alternatively, the fabrics are independently subjected to a constant-length heat-setting treatment in the same manner as described above. Then, the respective fabrics are relaxed from the tension. In this state, the fabrics are substantially equal in length. The fabrics are piled together on the needling machine, and when they are then needled, the lengths of the fabrics can be uniformalized very easily under application of a tension.

The present invention will now be described in detail with reference to the following Examples.

EXAMPLE 1

A felt having a structure as shown in FIG. 3 was prepared by using an apparatus as shown in FIGS. 4-A and 5. As the double weave fabric 1, there was used a relatively non-compressible warp double weave fabric called "bat-on-mesh fabric" (formed by circular weaving using a warp obtained by combining three yarns, each consisting of three strongly twisted 840-denier nylon-66 multifilaments, strongly twisting the combined yarns and treating the resulting strongly twisted yarn with a resin to increase the hardness and a weft consisting of a nylon-6 monofilament having a diameter of 0.47 mm), and as the single weave fabric 2, there was used a plain weave fabric customarily used as the single weave bat-on-mesh ground fabric (formed by circular weaving using a warp obtained by twisting two yarns, each consisting of two nylon-6 monofilaments having a diameter of 0.2 mm and combinining and twisting three of the so-twisted yarns and a weft consisting of a nylon-6 monofilament having a diameter of 0.33 mm).

It was found that when the above-mentioned double weave fabric was combined with a lap and formed into a needle felt, the fabric was shrunk by 4 to 5% by needling of the first cycle, and that when the above-mentioned single weave fabric was similarly treated, the fabric was shrunk by 2 to 3%.

Both the fabrics were piled together and set on stretch rolls as shown in FIG. 5, and the piled fabrics were elongated to the finish length and thermally set by hot air at 150° to 160° C. The tension applied to the two fabrics as a whole was 2.5 kg/cm at the time of starting and 1.5 kg/cm at the time of completion. Then, the fabrics were set on a needling machine as shown in FIG. 4-A and a tension of 1.5 kg/cm (to both the fabrics) was applied so that each fabric was kept strained. In this state, the needling operation was started. Three layers of nylon-66 staple fibers having a basis weight of 120 g/m$^2$ were supplied as the lap and the needling operation was carried out, and then, three layers of nylon-66 staple fibers having a basic weight of 120 g/m$^2$ were further supplied and the needling operation was conducted again. During the needling operation, every time needling of one layer was completed, the tension on the ground fabric was slightly reduced.

EXAMPLE 2

A ground fabric was formed by using two fabrics. As the fabric to be located on the back surface side, there was used a warp double weave endles fabric obtained by using a warp formed by twisting three yarns, each consisting of two twisted nylon-6 monofilaments having a diameter of 0.2 mm and a waft formed by twisting three nylon-6 monofilaments having a diameter of 0.20 mm, and as the fabric to be located on the lap side, there was used a 1/3 twill weave endless fabric obtained by using the same warp as described above and a weft formed by twisting three nylon-6 monofilaments having a diameter of 0.15 mm. Since the same warp was used for the above-mentioned two fabrics, the length difference between the two fabrics was not so large. More specifically, the length of the warp double weave fabric before needling was 97% of the intended finish length and the length of the single weave fabric before needling was 97.5% of the intended finish length. Accordingly, the preliminary heat setting was not carried out, and each fabric was lightly treated at 80° C. by an ordinary cylinder drier so that the irregularity of the selvage portion of the circular weave was corrected to arrange the shape. The two fabrics were piled and while the fabrics were stretched by the needling machine, four layers of 20-denier nylon-6 staple fibers having a basic weight of 120 g/m$^2$ were bonded as a lap to the single weave fabric. Then, two layers of 6-denier nylon-66 staple fibers having a basic weight of 150 g/m$^2$ were further bonded to obtain a needle felt.

COMPARATIVE EXAMPLE

A warp obtained by twisting three yarns, each consisting of two twisted nylon-6 monofilaments mentioned above (the diameter was 0.2 mm) and a weft obtained by twisting three nylon-6 monofilaments (having a diameter of 0.15 mm) were used, and a triple weave fabric (front-back 5/1 twill triple weave) was formed and used as the ground fabric. The ground fabric was needled with the same laps as used in Example 2 to obtain a needle felt.

The foregoing three felts were independently treated for 4 days by a press roll machine in which a linear pressure of 80 kg/cm was applied to the felts. After the test, the three felts were compared with one another with respect to sagging and the like. The obtained results are shown in the following Table. From these results, it will readily be understood that the felt of the present invention has a high bulk (that is, a large void capacity) and even if it is subjected to pressing repeatedly sagging is hardly caused.

TABLE

| | Basis Weight (g/m$^2$) of Felt | | Before Pressing Test | | | After Pressing Test | | |
|---|---|---|---|---|---|---|---|---|
| | ground fabric | lap | thickness (mm) | air permeability (cm/sec) | density (g/cm$^3$) | thickness (mm) | air permeability (cm/sec) | density (g/cm$^3$) |
| Example 1 | 260<br>622 | 720 | 5.40 | 22 | 0.297 | 3.97 | 12 | 0.404 |
| Example 2 | 260<br>573 | 780 | 5.21 | 18 | 0.310 | 4.05 | 10 | 0.398 |
| Comparative Example | 703 | 780 | 4.95 | 24 | 0.299 | 3.28 | 9 | 0.452 |

What is claimed is:

1. A method for producing a felt for paper manufacture, which comprises subjecting at least two endless non-compressible fabrics having at least one of a single weave or double combination weave structure to stretching and setting so that the endless non-compressible fabrics are thermally set under such a tension as will keep a substantially equal length in the fabrics, piling the fabrics in the annular form to form a ground fabric, placing a lap on said ground fabric, and needling the lap placed on the ground fabric while travelling the ground fabric under such a tension that all the layers are kept strained, whereby the lap is combined with the surface of the ground fabric and the endless non-compressible fabrics are also combined with each other.

2. A method for producing a felt for paper manufacture as set forth in claim 1, wherein the at least two fabrics are subjected to stretching and setting in the state in which the fabrics are piled in the annular form.

3. A method for producing a felt for paper manufacture as set forth in claim 1, wherein the stretching is carried out under a tension produced by a force of approximately 2.5 kg/cm$^2$ initially which is gradually reduced to 1.5 kg/cm$^2$.

4. A method for producing a felt for paper manufacture as set forth in claim 1, wherein the thermal setting is accomplished with hot air.

5. A method as set forth in claim 1, wherein the thermal setting is accomplished at a temperature of between 150° centigrade and 160° centigrade.

6. A method for producing a felt for paper manufacture as set forth in claim 1, wherein the needling is accomplished with the ground fabric under a tension produced by a force which is on the average from about 0.3 to about 5 kg/cm$^2$ per fabric.

7. A method for producing a felt for paper manufacture as set forth in claim 1, wherein the at least two fabrics are independently subjected to stretching and setting prior to being piled in the annular form.

* * * * *